US006472038B1

(12) United States Patent
Murphy

(10) Patent No.: US 6,472,038 B1
(45) Date of Patent: Oct. 29, 2002

(54) EXCHANGEABLE DECORATIVE FRAME COVER

(76) Inventor: Jennifer Murphy, 9278 SW. 146 Ct., Miami, FL (US) 33186

( * ) Notice: Subject to any disclaimer, the term of this patent is extended or adjusted under 35 U.S.C. 154(b) by 158 days.

(21) Appl. No.: 09/583,023

(22) Filed: May 30, 2000

(51) Int. Cl.[7] ..... A47G 1/06

(52) U.S. Cl. ..... 428/40.1; 40/702; 40/737; 40/772; 40/798; 428/13; 428/14; 428/41.5; 428/41.6; 428/42.1; 428/194

(58) Field of Search ..... 428/40.1, 41.5, 428/41.6, 42.1, 194, 13, 14; 40/702, 737, 772, 798

(56) References Cited

U.S. PATENT DOCUMENTS 5,916,650 A * 6/1999 Rosenbaum ..... 428/40.1

* cited by examiner

*Primary Examiner*—Nasser Ahmad
(74) *Attorney, Agent, or Firm*—Cuspa Technology Law Associates

(57) ABSTRACT

An exchangeable decorative frame cover is provided for decoration. The exchangeable decorative frame cover includes a frame cover made of flexible material with a shape adaptable to a solid frame, and a means for securing the frame cover on to the solid frame, and releasing the frame cover from the solid frame. The exchangeable decorative frame cover can be made of fabric, leather, fur and plastics. Additionally, a kit is also provided, which contains a plurality of exchangeable decorative frame covers for providing a decorative picture frame an ability to be matched with eclectic decor. The kit can further include a picture frame together with a plurality of exchangeable decorative frame covers.

13 Claims, 5 Drawing Sheets

EXCHANGEABLE DECORATIVE FRAME COVER

FIELD OF THE INVENTION

The present invention relates in general to the field of decorative articles, and more particularly to an exchangeable decorative picture or photo frame cover.

BACKGROUND OF THE INVENTION

Picture or photo frames are used for displaying photo, artistic, or memorable items. Additionally, the picture or photo frames themselves also contain aesthetic, and decorative features. These decorative features not only need to be matched with the content that a picture frame displays, very commonly, they also need to be matched with surrounding environments.

Picture or photo frames are available in many shapes, colors, materials, styles, and designs. The variety of available designs, styles, and materials serve to satisfy aesthetic appearance. However, once a picture frame is obtained its appearance is unchangeable unless the picture frame is replaced. It is common in a household that after a furniture change, a new interior design or a remodelling some picture frames no longer match with the overall design, or new surrounding environments. Sometimes, a picture frame is in a good physical condition, but its style becomes out of fashion, or original decoration becomes inappropriate. Although picture frames are not expensive items, it is wasteful to dispose of them simply because they lack of certain decorative appearance.

On the other hand, most picture and photo frames are designed to be decorative articles having their own aesthetic features without consideration of the environment they may be placed in. It is particularly difficult to find picture or photo frames matching with fabrics used for interior design, such as drapery, bedding, sofa cover and furniture. In addition, even if a new picture frame is decorated with matching fabric, once the surrounding designs change, the picture frame would no longer hold the matching features. Therefore, it is desirable to provide a decorative picture frame an ability to be matched with eclectic décor. It is also desirable to be able to change aesthetic appearances of a picture frame conveniently and inexpensively.

SUMMARY OF THE INVENTION

One object of the present invention is to provide a decorative picture frame an ability to be matched with eclectic decor.

Another object of the present invention is to provide an exchangeable decorative frame cover. The appearance of the frame may be readily changed by removing the frame cover and replacing with another frame cover. In this manner, a single picture or photo frame may be used to accommodate various surrounding environments.

Still another object of the present invention is to provide a convenient means for displaying decorative element, such as printed fabrics and decorative embellishment.

Yet another object of the present invention is to provide a safety means for protecting children's hands from a sharp edge or corners of a picture frame, and a means for protecting surface of furniture from scratching.

A further object of the present invention is to provide an economical means to reuse outdated frames for decoration.

Still a further object of the present invention is to provide consumers a kit of exchangeable decorative frame covers. A kit contains a plurality of exchangeable decorative frame covers for providing a decorative picture frame an ability to be matched with eclectic decor. In addition, the kit can also contain a picture frame wherein the exchangeable decorative frame covers have a shape matching the frame.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
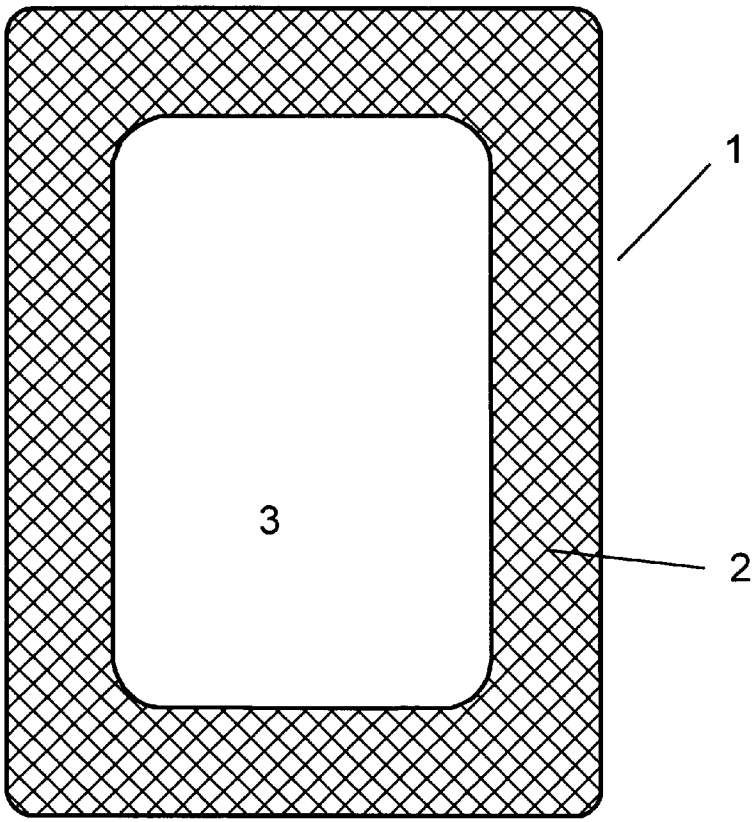
FIG. 1 is a perspective view of a decorative frame cover at the front of a photo frame with a rectangular opening.

Referring now to the drawings, FIG. 1 shows the front of a solid picture frame 1 covered by an exchangeable decorative frame cover 2 of the present invention. The exchangeable decorative frame cover comprises a frame cover made of flexible material with a shape adaptable to the picture frame, and a means for securing the frame cover on to the picture frame, and releasing the frame cover from the picture frame.

Figure 2:
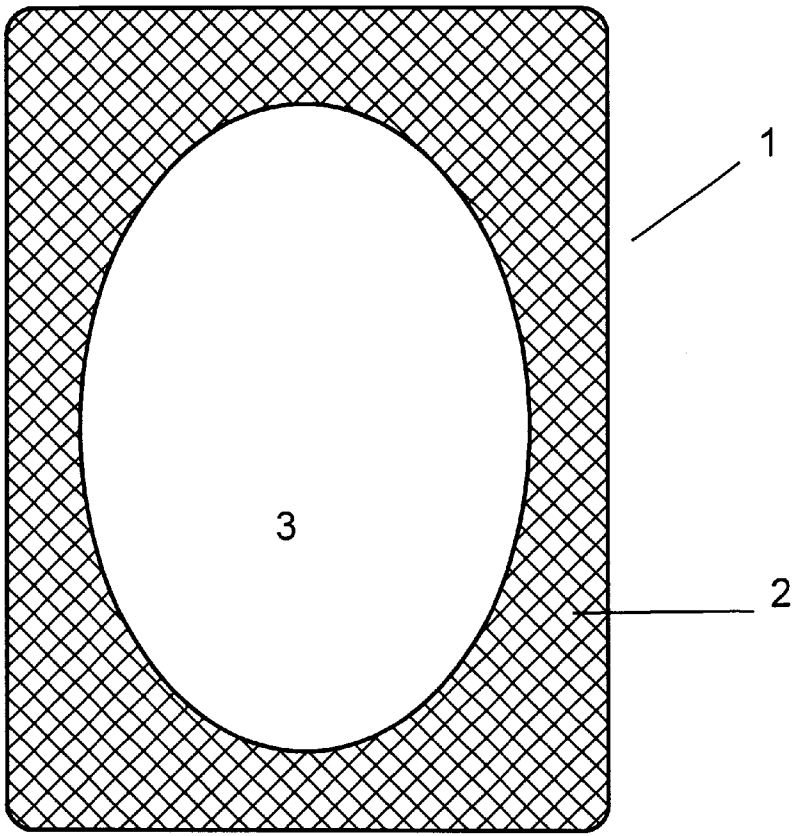
FIG. 2 is another perspective view of a decorative frame cover at the front of a photo frame with an oval opening.

The frame cover has a front side and a back side. The front side has an opening 3 that is adaptable to the picture frame for viewing contents in the picture frame. The size and shape of opening 3 depends on the particular picture frame that the frame cover is used for. FIG. 1 illustrates a rectangular shape front opening of the frame cover to accommodate the rectangular opening of the picture frame. While in FIG. 2, the front opening of the frame cover is oval to accommodate a similar shape of opening of the picture frame. However, the size and shape of the front opening of the frame cover does not need to be identical to the front opening of the picture frame. The size and shape can be designed for a particular purpose of decoration.

Figure 8:
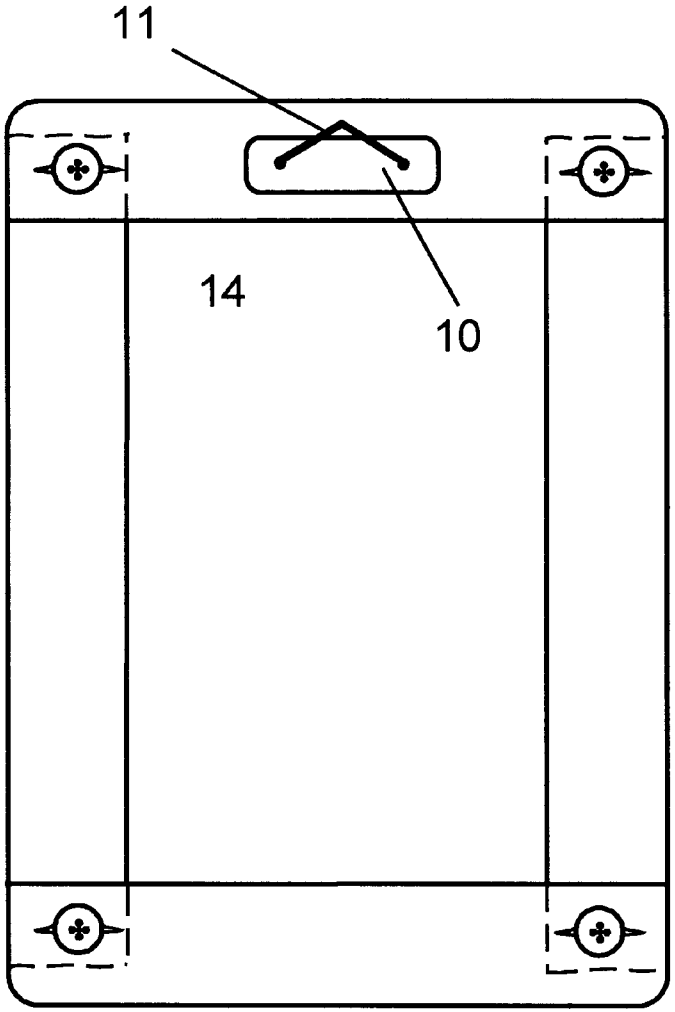
FIG. 8 is a back perspective view of a decorative frame cover with an opening to adapt hanger(s) of the frame.
Figure 7:
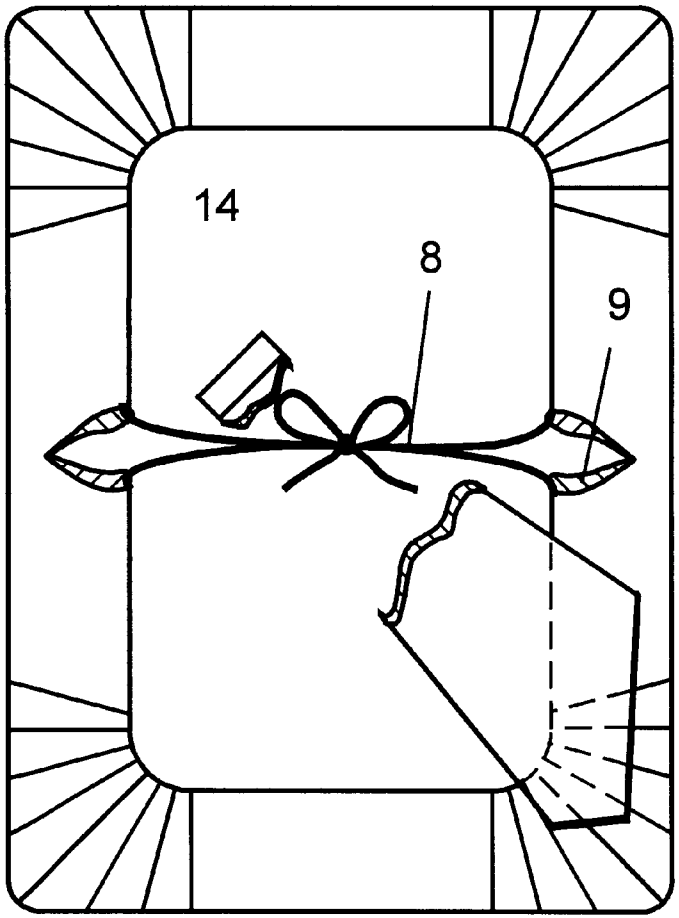
FIG. 7 is a back perspective view of a decorative frame cover tighten at the back side of a frame cover by strings from opposite sides of the frame.

The back side of the exchangeable decorative frame cover also has an opening 14 that is adaptable to a frame stand 4. There is no specific requirement on the size and shape of the back opening, as long as it is compatible with the frame stand. Alternatively, if the picture frame is going to be hung, such as on a wall, the back side of the frame cover can have an additional or a different opening 10 to adaptable to the hanger 11, as shown in FIG. 8.

Figure 3:
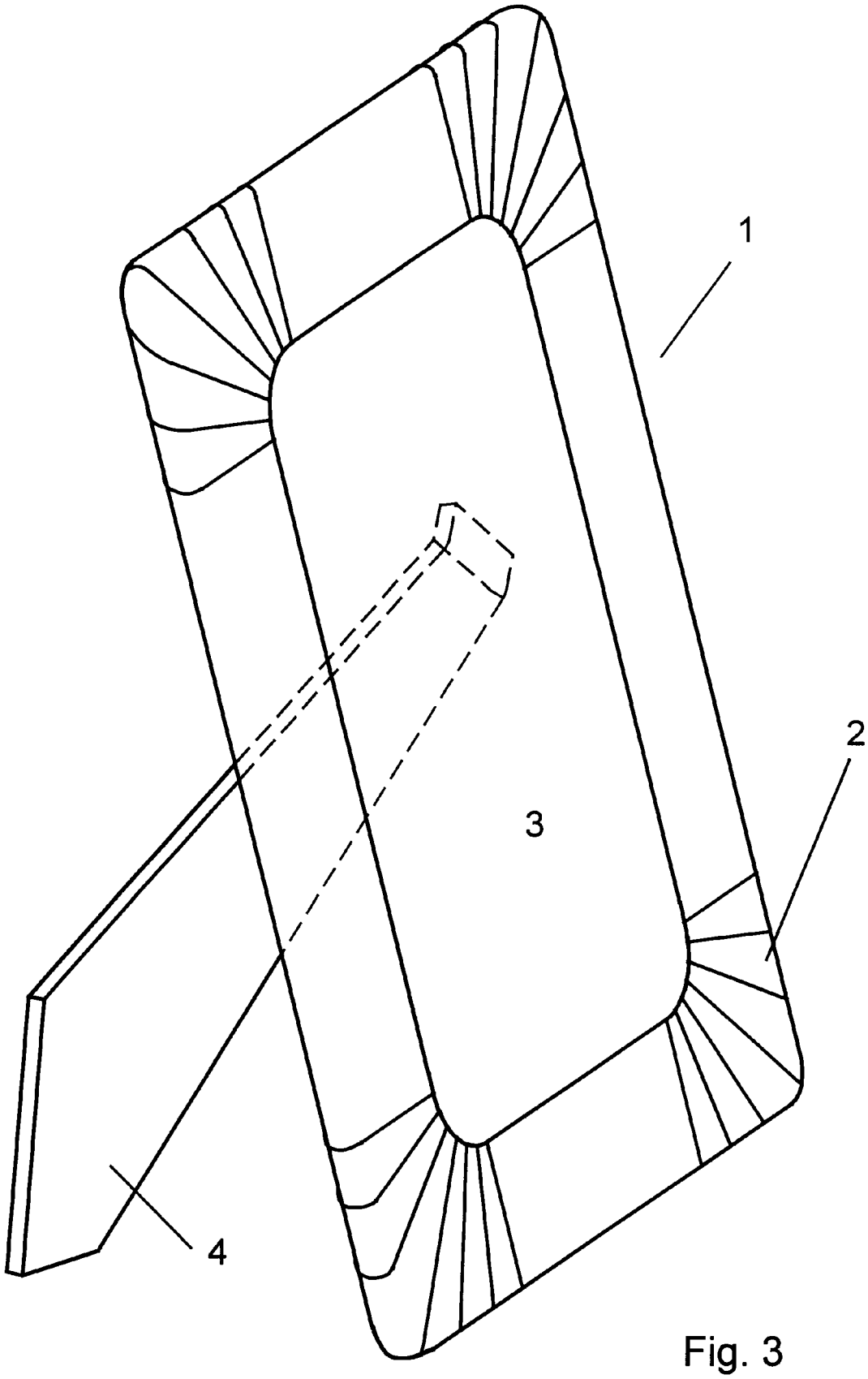
FIG. 3 is a side view of a photo frame covered by a decorative frame cover of the present invention.
Figure 6:
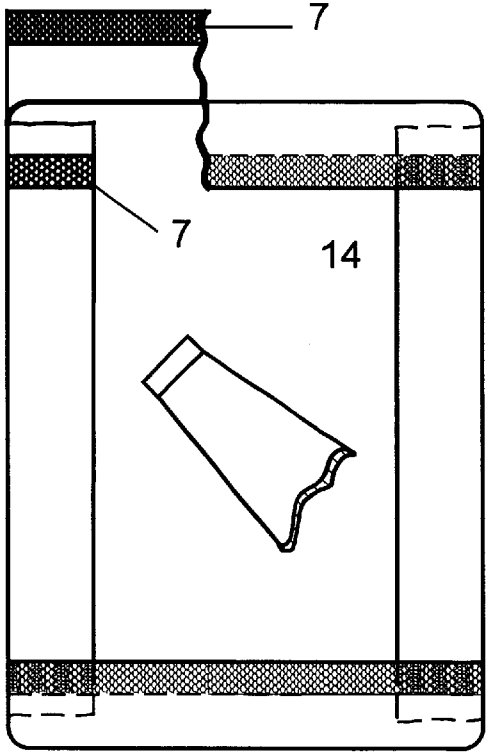
FIG. 6 is a back perspective view of a decorative frame cover closed at the back side of a frame cover by Velcro.
Figure 5:
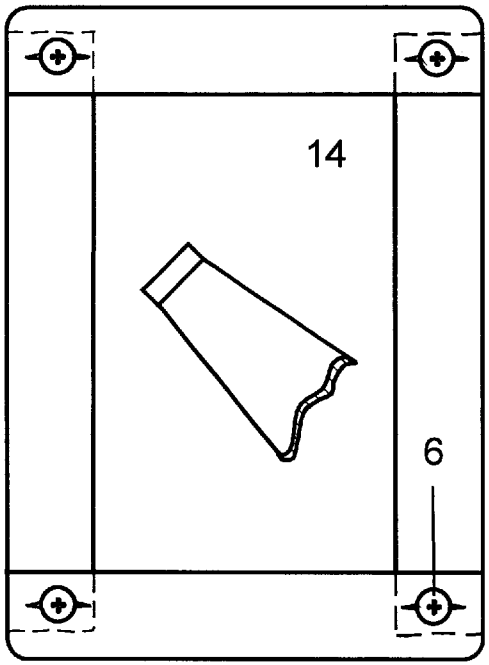
FIG. 5 is a back perspective view of a decorative frame cover closed at the back side of the frame cover by buttons.
Figure 4:
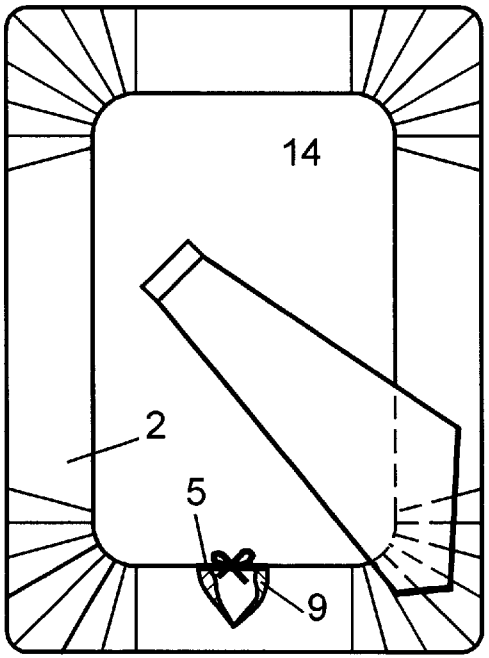
FIG. 4 is a back perspective view of a decorative frame cover tighten by an elastic string along the periphery of the back side of the frame cover.
Figure 9:
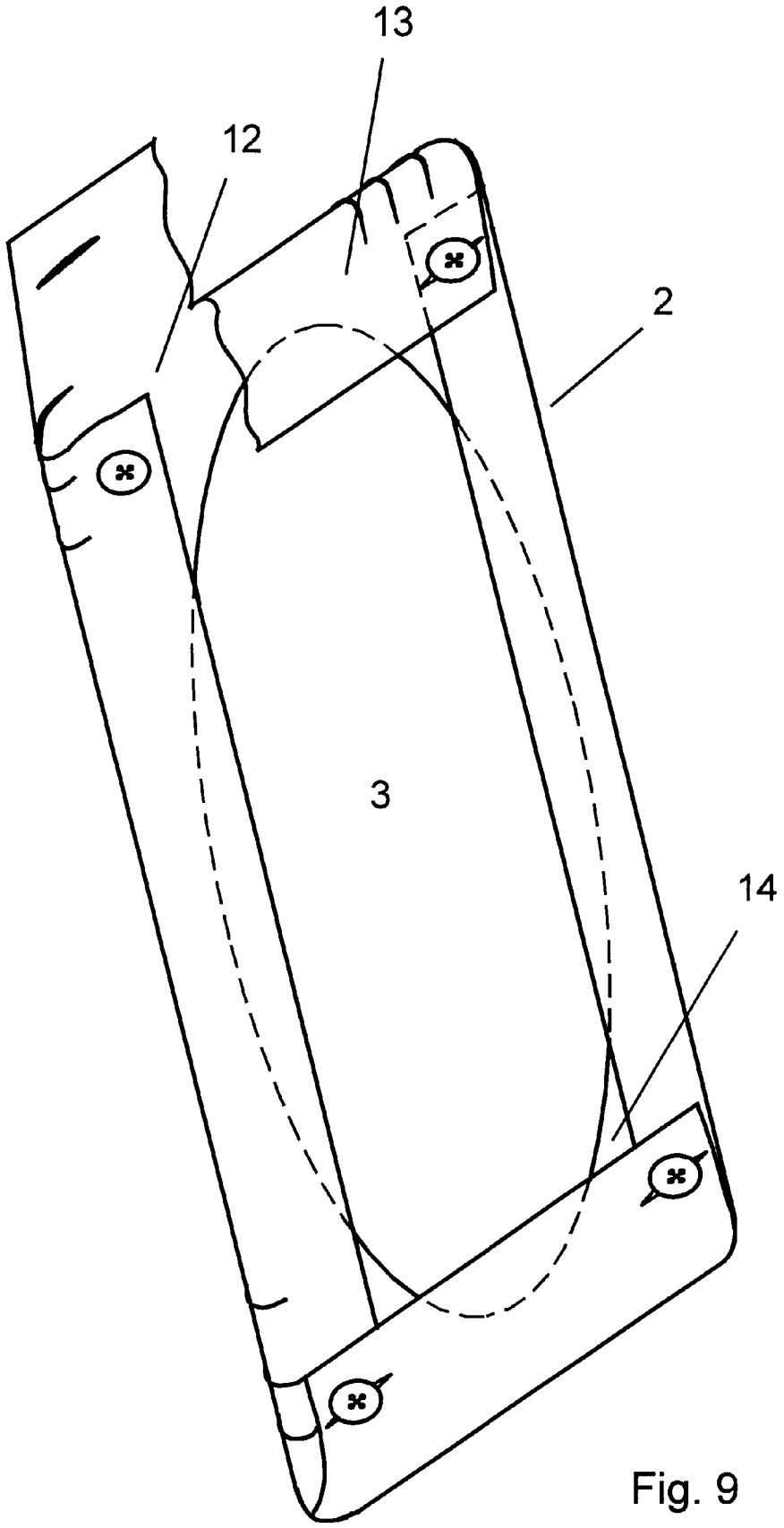
FIG. 9 is a perspective view of the decorative frame cover of the present invention.

FIG. 3 shows a side view of a photo frame covered by an exchangeable decorative frame cover of the present invention. FIG. 9 shows an exchangeable decorative frame cover having an oval front opening and a rectangular back opening.

The exchangeable decorative frame cover is made of flexible material, such as fabric, leather, fur and plastic. The color, style and design of the material can be determined depending on users' taste, interests, and decorating purposes. The materials of the frame covers can be tailored and manufactured using known techniques to those ordinary skilled in the art.

Furthermore, additional decorative embellishments or ornaments can be added on to the frame cover, such as animal symbols for decorating children's photo frames. In this manner, the exchangeable decorative frame cover of the present invention also provides a convenient means for displaying decorative element, such as printed fabrics and decorative embellishment.

The means for securing the frame cover on to, and releasing the frame cover from the picture frame can be an elastic string 5, non-elastic string 8, buttons 6 or snaps, and adhesive plastic 7 such as VELCRO™. FIGS. 4–7 illustrate different modes of securing the frame cover on to a picture frame using an elastic string, buttons, Velcro, and a string, respectively. When a string is used as the means for securing and releasing the frame cover, the string is embedded inside and along periphery of the frame cover. In this case, the frame cover is made to enable to attach the string, such as leaving a channel and opening 9 for introducing a string. The frame cover can be sold with a string built in. Customers can also introduce or change a string by themselves. With any of these means the frame cover can be easily put on, taken off, and changed from the picture frame.

Furthermore, the exchangeable decorative frame cover can also have a filling material embedded inside said frame cover. The filling material can be cotton, polyester, or other suitable material. A frame cover filled with a filling material can have a different decorative appearance. In addition, a frame cover filled with a soft filling can be used for protecting children's hands from sharp edge or corners of a picture frame when it is used in the household having young children. The same feature can also be used for protecting surface of furniture from scratching from a sharp edge or corners of a picture frame.

Moreover, since the exchangeable decorative frame cover is made of flexible material, the frame cover can be made reversible between its exterior 13 and interior 12. In this case, each side can have a different color or design so that one frame cover can provide more than one decorative feature.

The exchangeable decorative frame cover of the present invention can be used for various decoration purposes. With one of most perceivable utility of the present invention, a variety of print fabric can be used to make the exchangeable decorative frame covers to match with eclectic decor, such as drapery, bedding, and furniture. Interior designers can choose appropriate material to match their overall scheme. A furniture store can sell the exchangeable decorative frame covers of the present invention with different designs that match or accommodate different sets of furniture. A customer may purchase, or order from a catalog or through Internet, the frame covers for his or her decoration purpose.

With the exchangeable decorative frame covers of the present invention, a single picture frame can be decorated differently for different seasons, special events and occasions, such as birthday and graduation parties. When old picture or photo frames become out of fashion or worn out, they can be redecorated with the exchangeable decorative frame covers of the present invention conveniently and inexpensively.

Additionally, as described above, the exchangeable decorative frame covers of the present invention can be used as a safety means for protecting children's hands from a sharp edge or corners of a picture frame, as well as a means for protecting the surface of furniture from scratching.

In another embodiment, the present invention provides a kit for enabling a decorative picture frame to be matched with eclectic décor. The kit comprises a plurality of exchangeable decorative frame covers that can have different decorative features such color, material, and designs. With the kit, multiple picture frames can be decorated, or a signal picture frame can be changed differently with various frame covers.

In addition, the kit can further comprise a solid picture frame together with a plurality of exchangeable decorative frame covers. In this case, the solid picture frame can be made with or without decorative features, such as plain wood, plastic or metal. The appearance of the picture frame can be easily changed to different colors and designs of the multiple decorative frame covers provided in the kit.

While the present invention has been described in detail and pictorially shown in the accompanying drawings, these should not be construed as limitations on the scope of the present invention, but rather as an exemplification of preferred embodiments thereof. It will be apparent, however, that various modifications and changes can be made within the spirit and the scope of this invention as described in the above specification and defined in the appended claims and their legal equivalents.

I claim:

1. An exchangeable decorative frame cover comprising:

a frame cover made of flexible material for covering a solid frame, wherein said frame cover has a front side and a back side, said front side having a cut-out opening with a shape accommodating a front opening of said solid frame for viewing contents in said solid frame, and a means for securing said frame cover on to said solid frame, and releasing said frame cover from said solid frame.

2. The exchangeable decorative frame cover of claim 1, wherein said back side has an opening which accommodates a frame stand.

3. The exchangeable decorative frame cover of claim 1, wherein said back side has an opening which accommodates a frame hanger.

4. The exchangeable decorative frame cover of claim 1, wherein said flexible material is selected from the group consisting of fabric, leather, fur and plastic.

5. The exchangeable decorative frame cover of claim 1, wherein said flexible material is fabric.

6. The exchangeable decorative frame cover of claim 1, wherein said means for securing and releasing said frame cover is selected from the group consisting of button, snap, string, and adhesive plastic.

7. The exchangeable decorative frame cover of claim 1, wherein said means for securing and releasing said frame cover is an elastic string embedded inside and along periphery of said frame cover.

8. The exchangeable decorative frame cover of claim 1 further comprises filling material embedded inside said frame cover.

9. The exchangeable decorative frame cover of claim 1 is reversible, herein both interior and exterior of said frame cover are decorative.

10. A kit comprising a plurality of exchangeable decorative frame covers for providing a decorative picture frame an ability to be matched with eclectic decor, wherein each of said exchangeable decorative frame covers comprises:

a frame a frame cover made of flexible material for covering a solid frame, wherein said frame cover has a front side and a back side, said front side having a cut-out opening with a shape accommodating a front opening of said solid frame for viewing contents in said solid frame, and a means for securing said frame cover on to said solid frame, and releasing said frame cover from said solid frame.

11. The exchangeable decorative frame covers of claim 10, wherein said flexible material is selected from the group consisting of fabric, leather, fur and plastic.

12. The exchangeable decorative frame cover of claim 10, wherein said means for securing and releasing said frame cover is selected from the group consisting of button, snap, string, and adhesive plastic.

13. A kit for providing a decorative picture frame an ability to be matched with eclectic decor comprising:

a solid frame having a front opening which permits mounting of a picture for viewing, a plurality of exchangeable decorative frame covers, wherein each of said exchangeable decorative frame covers comprises:

a frame cover made of flexible material for covering said solid frame, wherein said frame cover has a front side and a back side, said front side having a cut-out opening with a shape accommodating said front opening of said solid frame for viewing contents in said solid frame, and a means for securing said frame cover on to said solid frame, and releasing said frame cover from said solid frame.

* * * * *